US006935873B2

(12) United States Patent
Funatsu

(10) Patent No.: US 6,935,873 B2
(45) Date of Patent: Aug. 30, 2005

(54) ELECTRICAL CONNECTOR

(75) Inventor: Akira Funatsu, Tokyo (JP)

(73) Assignee: Hirose Electic Co., Ltd., Tokyo (JP)

( * ) Notice: Subject to any disclaimer, the term of this patent is extended or adjusted under 35 U.S.C. 154(b) by 30 days.

(21) Appl. No.: 10/277,040

(22) Filed: Oct. 22, 2002

(65) Prior Publication Data

US 2003/0077929 A1 Apr. 24, 2003

(30) Foreign Application Priority Data

Oct. 22, 2001 (JP) ..... 2002-323534

(51) Int. Cl.[7] ..... H01R 13/44
(52) U.S. Cl. ..... 439/137
(58) Field of Search ..... 439/135, 136, 439/137, 138

(56) References Cited

U.S. PATENT DOCUMENTS 5,466,163 A * 11/1995 Barron et al. ..... 439/138
5,716,224 A * 2/1998 Masuda et al. ..... 439/138
5,796,579 A * 8/1998 Nakajima et al. ..... 361/683
6,113,409 A * 9/2000 Park ..... 439/310
6,332,781 B1 * 12/2001 Ito ..... 439/34

* cited by examiner

*Primary Examiner*—Thanh-Tam Le
(74) *Attorney, Agent, or Firm*—Takeuchi & Takeuchi

(57) ABSTRACT

An electrical connector system comprises a shutter (15) having shutter members (16 and 17) with arms (21) pivoted to the end walls of a receptacle (1). The shutter members (16 and 17) are biased by a spring member (18) such that the sliding sections (20) are closed to cover a plug fitting section (39) and opened by guide pins (37) that are provided on a plug connector (2).

11 Claims, 8 Drawing Sheets

ELECTRICAL CONNECTOR

BACKGROUND OF THE INVENTION

1. Field of the Invention

The present invention relates to an electrical connector for connecting a portable information processor, such as a notebook PC to a CD-ROM, such as an expansion hard disk.

2. Description of the Related Art

Japanese patent application Kokai No. 2000-36355 discloses such an electrical connector. As FIGS. 10 and 11 show, the electrical connector consists of a receptacle 51 and a detachable plug 60 to be plugged in the receptacle 51. The receptacle 51 is mounted on a printed circuit board 53 that has an opening for receiving the plug 60. A pair of guide apertures 52 are provided in the PCB 53 on opposite sides of the receptacle 51. An opening 56 is provided in the bottom wall of a case 55 for a portable information processor. A pair of shutter members 57 and 58 are pivoted to the case 55 to cover the opening 56 so as to prevent dust and dirt from entering the case 55. The PCB 53 with the receptacle 51 is provided in the case 55 such that the plug insertion opening is aligned with the opening 56 and the plug fitting section of the receptacle 51 is closed by the shutter members 57 and 58.

In FIG. 11, the plug 60 is mounted on a case 61 of DC-ROM. A pair of separate guide pins 62 are provided on the case on opposite sides of the plug 60. To connect the portable information processor to the CD-ROM, the portable information processor is brought over the DC-ROM such that the guide pins 62 are inserted into the guide apertures 52 to abut against the inside edges 57*a* and 58*a* of the shutter members 57 and 58, rotating outwardly the shutter members 57 and 58 to open the plug fitting section of the receptacle 51. Then, the plug 60 is fitted in the plug fitting section of the receptacle 51, bringing the signal terminals of the receptacle 51 into contact with the signal terminals of the plug 60, thus connecting the receptacle 51 and the plug 60.

To disconnect the portable information processor from the DC-ROM, the portable information processor is lifted from the DC-ROM so that the guide pins 62 come out of the guide apertures 52, and the plug 60 comes out of the plug fitting section of the receptacle 51, disconnecting the signal terminals of both the connectors 51 and 60. The shutter members 57 and 58 rotate inwardly to cover the plug fitting section of the receptacle 51.

However, in the above multi-pole connector, the receptacle 51 and the shutter members 57 and 58 are separated, and the opening of the PCB 53 must be aligned with the opening 56 so that the plug fitting section of the receptacle 51 is covered by the shutter members 57 and 58. If the shutter members 57 and 58 are moved even slightly, they suffer malfunction, preventing the connection between the receptacle 51 and the plug 60.

In addition, the guide pins 62 for opening the shutter members 57 and 58 is a separate member from the plug 60 and is attached to the case 61 of CD-ROM so that the length L1 between the guide pins 62 is greater than the length L2 of the plug 60, increasing the size and the number of components for the shutter members 57 and 58 and the shutter mechanism including the guide pins 62, making the shutter mechanism complicated.

SUMMARY OF THE INVENTION

Accordingly, it is an object of the invention to provide an electrical connector capable of minimizing not only the displacement of the shutter with respect to the mating connector, thus reducing the malfunction due to the displacement and facilitating connection between the connectors but also the size and the number of components.

According to the invention there is provided an electrical connector system comprising a first connector including a mating connector fitting section and a shutter made by a pair of shutter members for closing said mating connector fitting section; a second connector; and a mechanism for moving said shutter members to open said mating connector fitting section for receiving said second connector, thereby connecting said first and second connectors.

The moving mechanism may be a guide pin provided on said second connector. The shutter may comprise a pair of sliding sections provided at edges thereof for sliding said guide pin, and a pair of arms provided at opposite ends in a lengthwise direction thereof and rotatably supported to opposite wall ends of said first connector for attaching said pair of shutter members to said first connector, and wherein said first connector comprises a spring member for pulling said pair of shutter members toward each other to keep said sliding sections close to each other, thereby covering said mating connector fitting section.

Also, the shutter may comprise one of a shaft and a bearing hole, and said arm comprises the other of said shaft and bearing hole so that said pair of shutter members is rotatably attached to said first connector by engagement between said shaft and said bearing hole. The shutter may further comprise a stopper and said arm comprises a stopper section so that said stopper section abuts against said stopper section when said pair of shutter members are pulled toward each other by said spring member. The shutter may further comprise one of a shaft and an elongated bearing hole, and said arm comprises the other of said shaft and elongated bearing hole so that said pair of shutter members is rotatably attached to said first connector by engagement between said shaft and said elongated bearing hole.

The first connector may be a low-profile connector comprising an insulating case having a terminal channel forming section that extends toward said mating connector fitting section. The pair of shutter members may be made from either metal or heat-resistant plastic.

DESCRIPTION OF THE PREFERRED EMBODIMENTS

Figure 1:
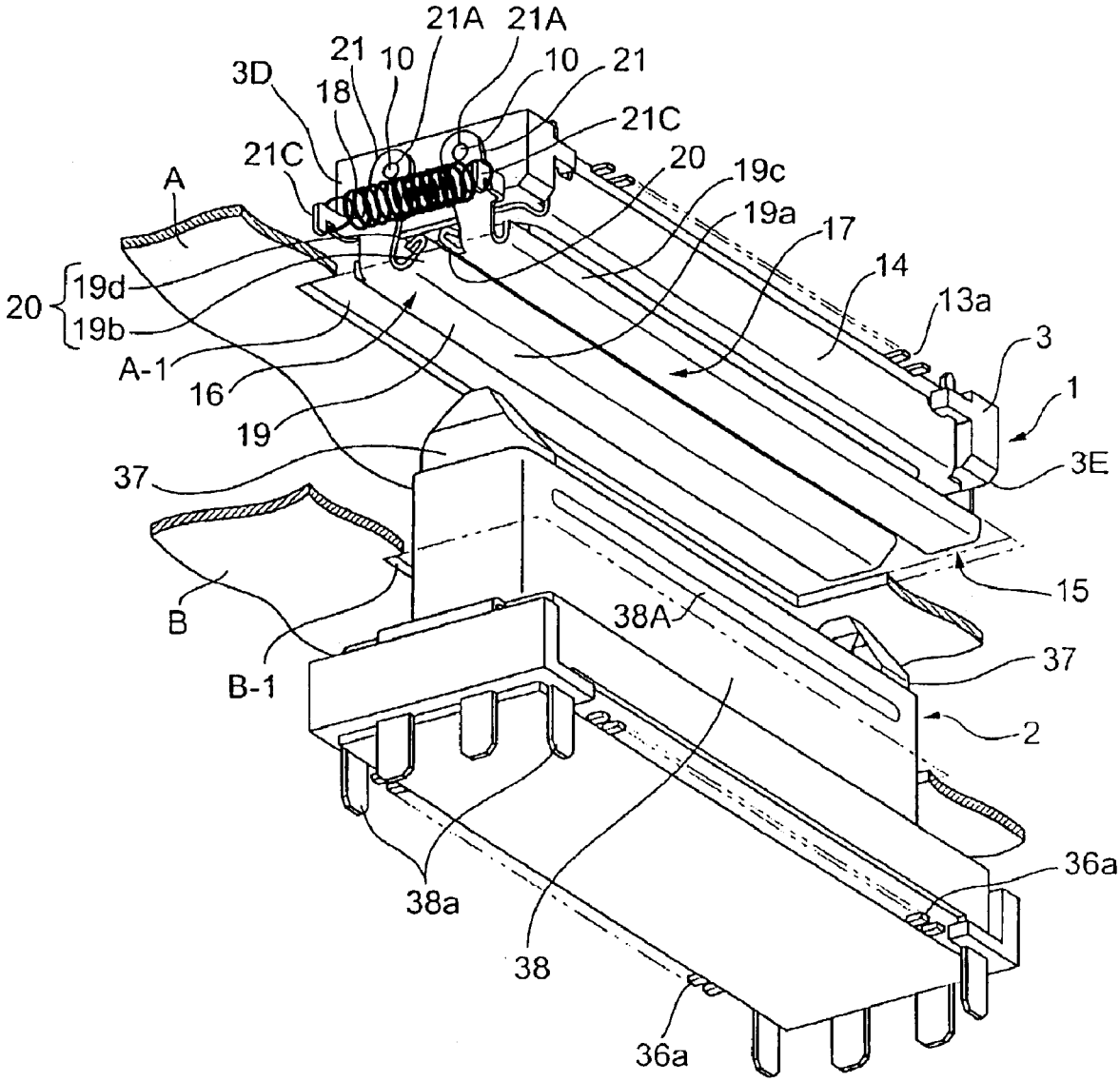
FIG. 1 is a perspective view of electrical connectors according to the first embodiment of the invention before connection.
Figure 2:
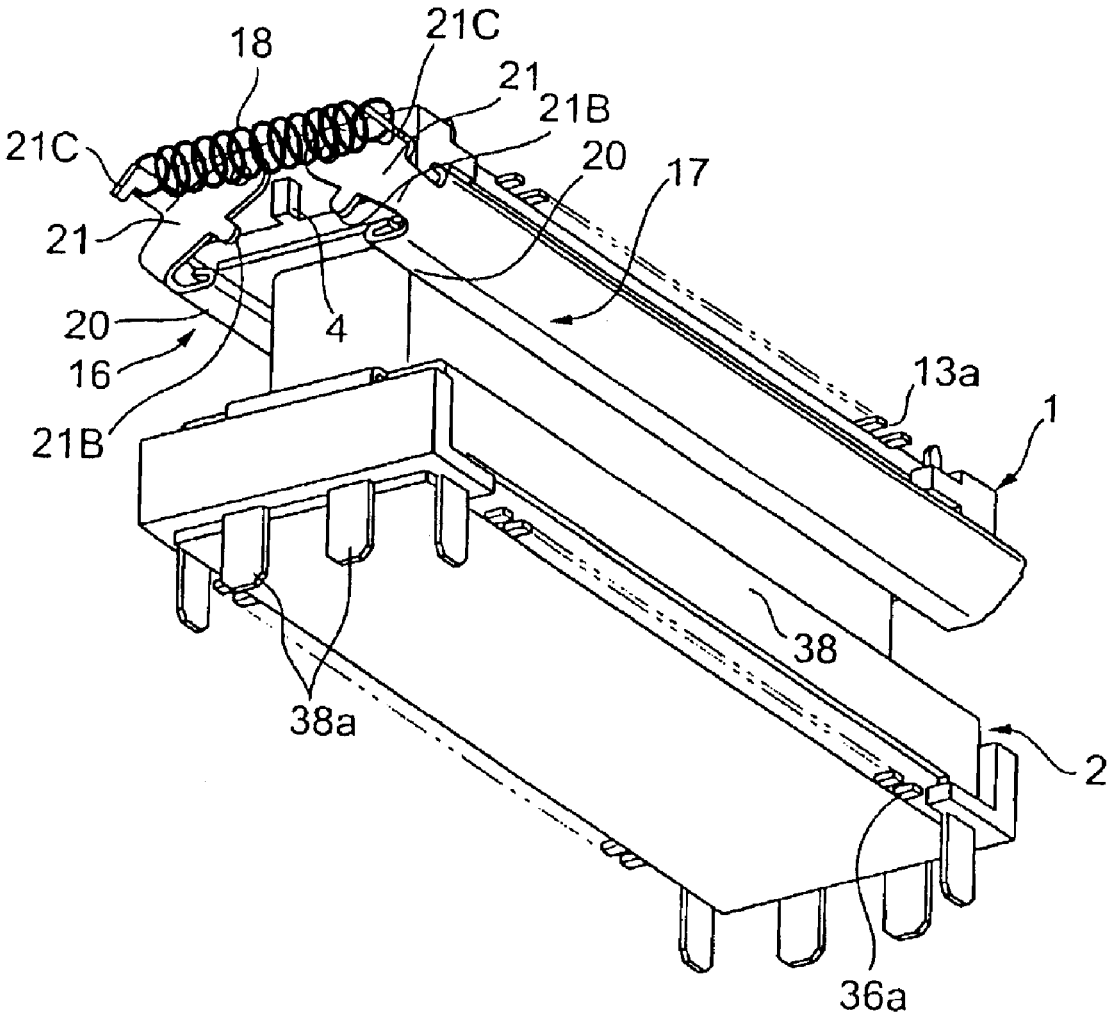
FIG. 2 is a perspective view of the electrical connectors after connection.
Figure 3:
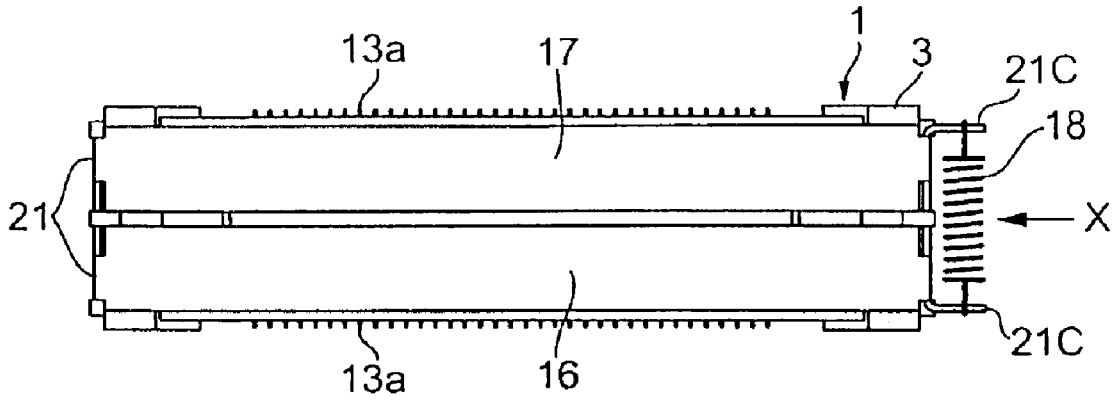
FIG. 3 is a plan view of the receptacle connector with a shutter.

In FIGS. 1–8, a multi-pole connector according to the first embodiment of the invention consists of a receptacle 1 and a plug 2 to be connected to the receptacle 1. As shown in FIG. 1, the receptacle 1 is provided within a rectangular opening A-1 provided in the bottom wall of a case A for a portable information processor such as a notebook personal computer. The plug 2 is provided within an opening B-1 provided in a wall of the case B of a CD-ROM or expansion hard desk.

As shown in FIGS. 3–6, the receptacle 1 comprises an insulating case 3 which has a rectangular face 3A, a pair of side faces 3B and 3C extending from the longitudinal edges of the face 3A, and a pair of end faces 3D and 3E extending from the minor edges of the faces 3A, and 3B and 3C. A pair of pin through-holes 6 are provided in opposite ends of the face 3A. A terminal recess bearing wall 7 is provided along the length of the face 3A. A pair of plugging recesses 8 and 9 are provided between the terminal recess bearing wall 7 and the side wall 3B and between the terminal recess bearing wall 7 and the side wall 3C, respectively, forming a plug fitting section 39. A stopper 4 is provided on each of the end faces 3D and 3E. A pair of pivots 10 are provided on opposite sides of the stopper 4.

Figure 4:
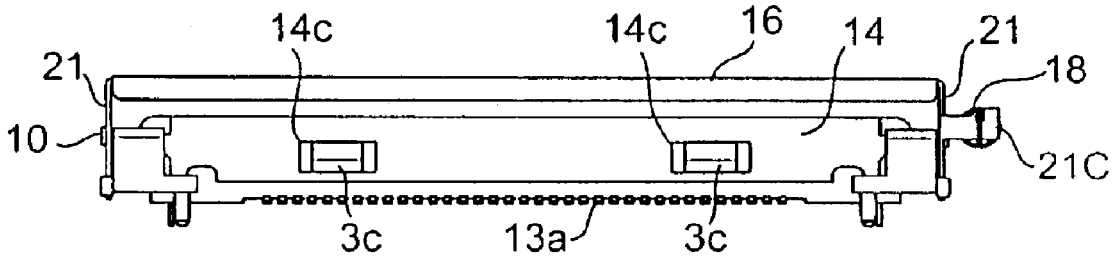
FIG. 4 is a side view of the receptacle connector.
Figure 5:
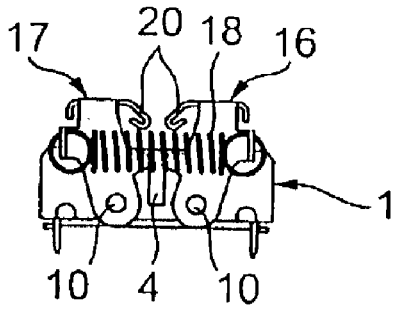
FIG. 5 is a view of the receptacle connector viewed from an arrow X of FIG. 3.
Figure 6:
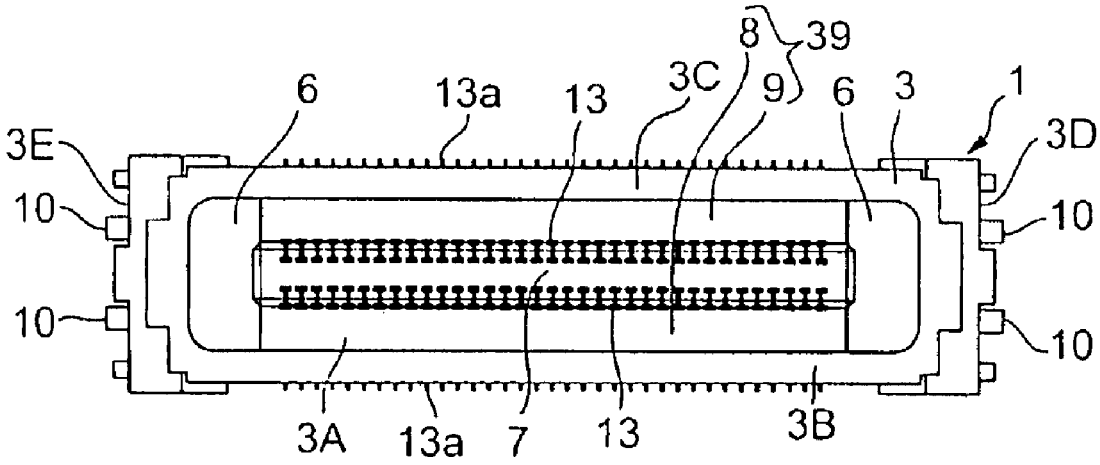
FIG. 6 is a plan view of the receptacle connector.
Figure 8:
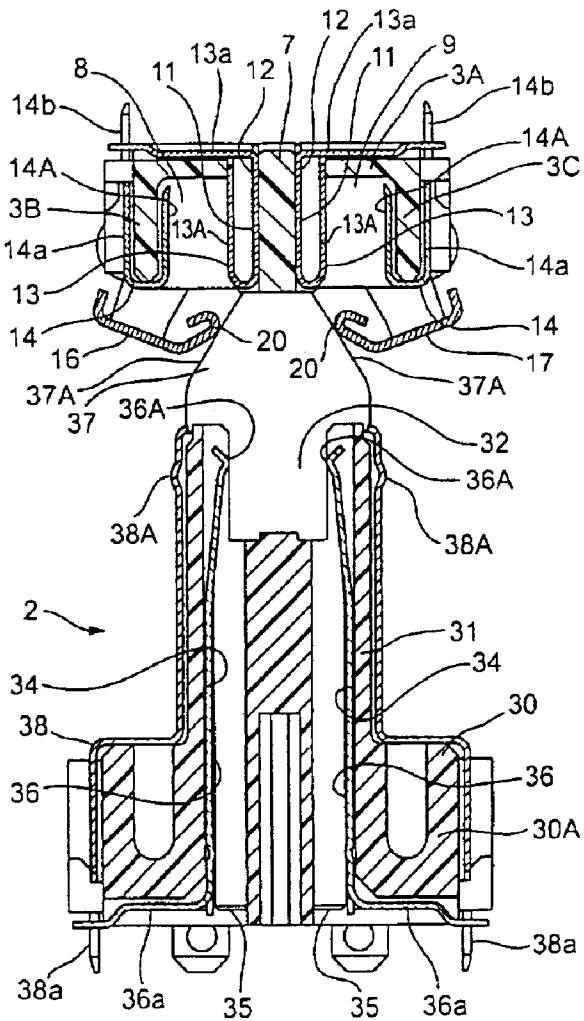
FIGS. 8(1) and (2) are sectional views of the electrical connectors showing their operation.
Figure 8:
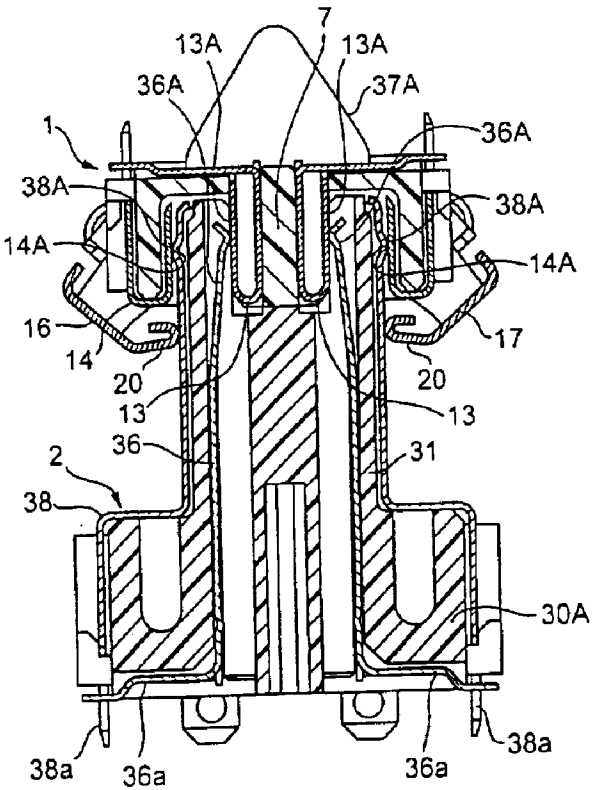

As shown in FIG. 8(1), a plurality of terminal recesses 11 are provided in opposite faces of the terminal recess bearing wall 7 in the longitudinal direction of the insulating case 3. A plurality of terminal apertures 12 in the face 3A communicating with the terminal recesses 11. The base of each signal terminal 13 is press-fitted in the terminal aperture 12 to install the signal terminal 13 in the terminal recess 11 such that the contact section 13A of the signal terminal 13 is exposed in the fitting recess 8 or 9. The lead 13*a* of the signal terminal 13 extends along the face 3A. A pair of shield plates 14 are provided over the side walls 3B and 3C. Each shield plate 14 has a U-shaped section and an inside contact section 14A. A pair of leads 14*b* are provided on opposite ends of the outside section 14*a*. A plurality of engaging holes 14*c* are provided in the outside section 14*a* (FIG. 4). The shield member 14 is attached to the side walls 3B and 3C by engaging the engaging holes 14*c* with the engaging projections 3*c* of the side walls 3B and 3C such that the contact faces 14A are provided in the fitting recesses 8 and 9 while the leads 14*a* project from the bottom wall 3A of the insulating case 3.

As shown in FIG. 1, a shutter 15 supported by the insulating case 3 comprises a pair of shutter members 16 and 17 and a spring member 18, such as a coil spring. The shutter member 16 has a rectangular shutter section 19 that is sufficiently large to cover the fitting recess 8 and has a central section 19*a*, an inside section 19*b*, and an outside section 19*c*. The inside section 19*b* is provided with a curved edge 19*d* and inclined at a predetermined angle with respect to the central section 19*a*, forming sliding section 20. A pair of arms 21 extend at right angles from opposite ends of the central section 19*a*. Each arm 21 has a hole 21A. A stopper 21B and a spring support 21C extend inwardly and outwardly from the arm 21, respectively. The shutter member 17 is in symmetry with the shutter member 16 and its description is omitted.

The shutter member 16 is attached to the insulating case 3 for rotation by inserting the shafts 10 of the end walls 3D and 3E into the shaft holes 21A of the arms 21. The shutter 17 is attached to the insulating case 3 for rotation by inserting the shafts 10 of the end walls 3D and 3E into the shaft holes 21A of the arm 21. Alternatively, the shafts 10 and shaft holes 21A may be provided on the arm 21 and the end walls 3D and 3E, respectively. The spring member 18 are provided between the spring supports 21C of the shutter members 16 and 17, respectively, biasing the shutter members 16 and 17 toward each other but the stopper sections 21B abut against the stoppers 4 to separate the sliding sections 20 of the shutter members 16 and 17. Under this closed condition, the shutter members 16 and 17 are in contact with the shield member 38 and cover the plug fitting section 39 that is made up of the fitting recesses 8 and 9 (FIG. 1).

Figure 7:
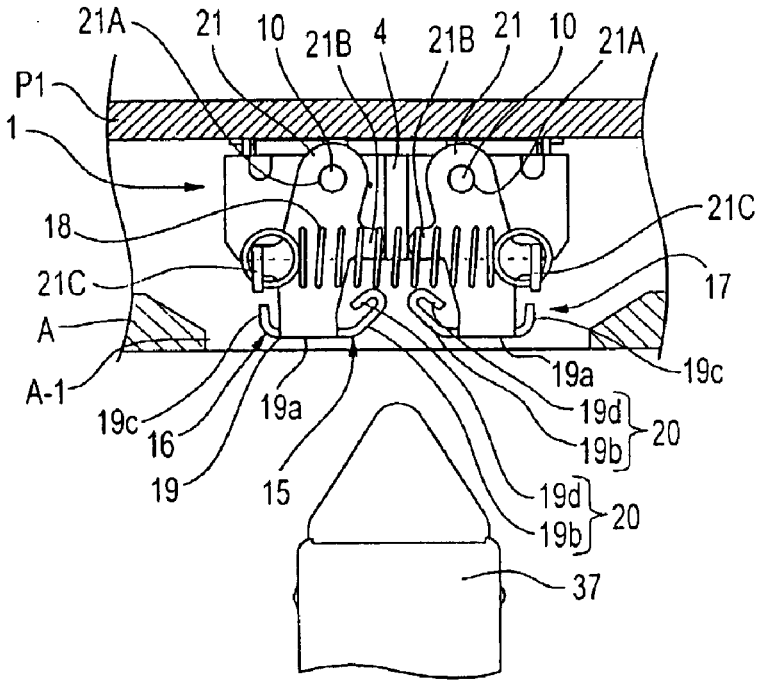
FIGS. 7(1) and (2) are sectional views of the electrical connectors showing the shutter operation.
Figure 7:
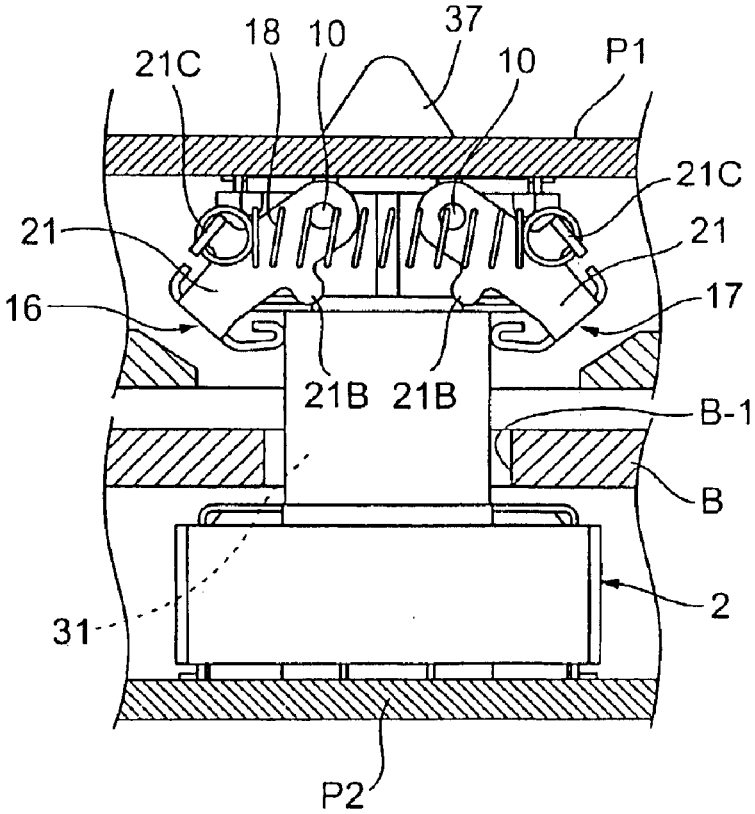

As shown in FIGS. 7(1) and (2), the receptacle 1 is mounted on a printed circuit board P1 within the case A such that it is located within the opening A-1.

As shown in FIG. 8(1), the plug 2 comprises an insulating case 30 that has a rectangular base section 30A and a fitting projection 31 extending from the base section 30A. A mating terminal receiving recess 32 extends along the length of the fitting projection 31. A plurality of terminal channels 34 are provided in the fitting projection 31. A plurality of terminal apertures 35 are provided through the base section 30A, communicating with the terminal channels 34. A plurality of signal terminals 36 are provided in the terminal channels 34 by press-fitting the base sections of the signal terminals 36 into the terminal apertures 35 such that the flexible contact sections 36A are exposed in the mating terminal receiving recess 32. The leads 36*a* of the signal terminals 36 extend along the outside of the base section 30A. A pair of shutter release or guide pins 37 extend from opposite ends of the fitting projection 31, each having a tapered guiding face 37A. A shield plate 38 is provided over the base section 30A and the fitting projection 31. It has a pair of contact projections 38A toward the front edges and a pair of leads 38*a* extending from the opposite ends through the base section 30A of the insulating case 30.

As shown in FIG. 7(2), the plug 2 is mounted on a printed circuit board P2 in the case B of a CD-ROM such that it is aligned with the opening B-1 of the case.

The receptacle 1 and the plug 2 are plugged and unplugged as follows.

Where a portable information processor is connected to the CD-ROM, the receptacle 1 is connected to the plug 2. As shown in FIGS. 7(1) and 8(1), when the portable information processor is brought closer to the DC-ROM, the guide pins 37 of the plug 2 are inserted between the sliding sections 20 of the receptacle 1. The guide plane 37A slides on the sliding sections 20 to rotate the shutter members 16 and 17 about the shafts 10 against the spring member 18 so that the fitting section 39 of the receptacle 1 is opened. Then, the guide pins 37 enter the pin through-holes 6 so that the fitting projection 31 of the plug 2 is fitted in the fitting recess 39 of the receptacle 1 while the signal terminals 13 of the receptacle 1 are inserted in the mating terminal receiving recess 32. Consequently, the contact sections 13A of the signal terminals 13 are brought into contact with the contact sections 36A of the signal terminals 36 while the contact section 14A of the shield member 14 is brought into contact with the contact section 38A of the shield member 38 so that the receptacle 1 and the plug 2 are connected.

To disconnect the portable information processor from the CD-ROM, the receptacle 1 is disconnected from the plug 2. That is, when the portable information processor is lifted up from the CD-ROM, the guide pins 37 come out of the pin apertures 6 of the receptacle 1, and the fitting projection 31 of the plug 2 comes out of the plug fitting section 39 of the receptacle 1 while the signal terminals 13 come out of the terminal slot 32 of the mating connector. Consequently, the signal terminals 13 and 36 are separated while both of the shield members 14 and 38 are separated, thereby disconnecting the receptacle 1 and the plug 2.

Then, the guide faces 37A of the guide pins 37 slide out of the sliding faces 20 of the shutter members 16 and 17 so that the spring members 18 rotate inwardly the shutter members 16 and 17 about the shaft 10 to cover the plug fitting section 39 of the receptacle 1. At this point, the stoppers 21B abut against the stoppers 4 to bring the shutter members 16 and 17 to the regular position.

According to the above first embodiment of the invention, a pair of shutter members 16 and 17 are provided on the receptacle 1 so that the precision with which the shutter members 16 and 17 are positioned with respect to the receptacle 1 is increased, thus minimizing the shutter malfunction due to the mispositioning and ensuring smooth connection between the receptacle 1 and the plug 2. Since the shutter members 16 and 17 are provided on the receptacle 1 and since the guide pins 37 are provided on the plug 2, not only the shutter mechanism including the guide pins 27 is minimized but also the number of parts or components is reduced. Furthermore, the receptacle 1 is a low-profile connector by providing the insulating case 3 with terminal channel forming section 7 that extends toward the plug fitting section 39 so that it is possible to attach the shutter members 16 and 17 to the low-profile connector. The shutter members 16 and 17 are made from a conductive material so that it is possible to ground the shutter members 16 and 17 by bringing them into contact with the shield members 14. The shutter members 16 and 17 may be made from a metal or heat-resistant plastic so that when the receptacle 1 is mounted on the printed circuit board P1, the shutter members 16 and 17 may be soldered to the receptacle 1, thus minimizing the number of manufacturing steps.

Second Embodiment

Figure 9:
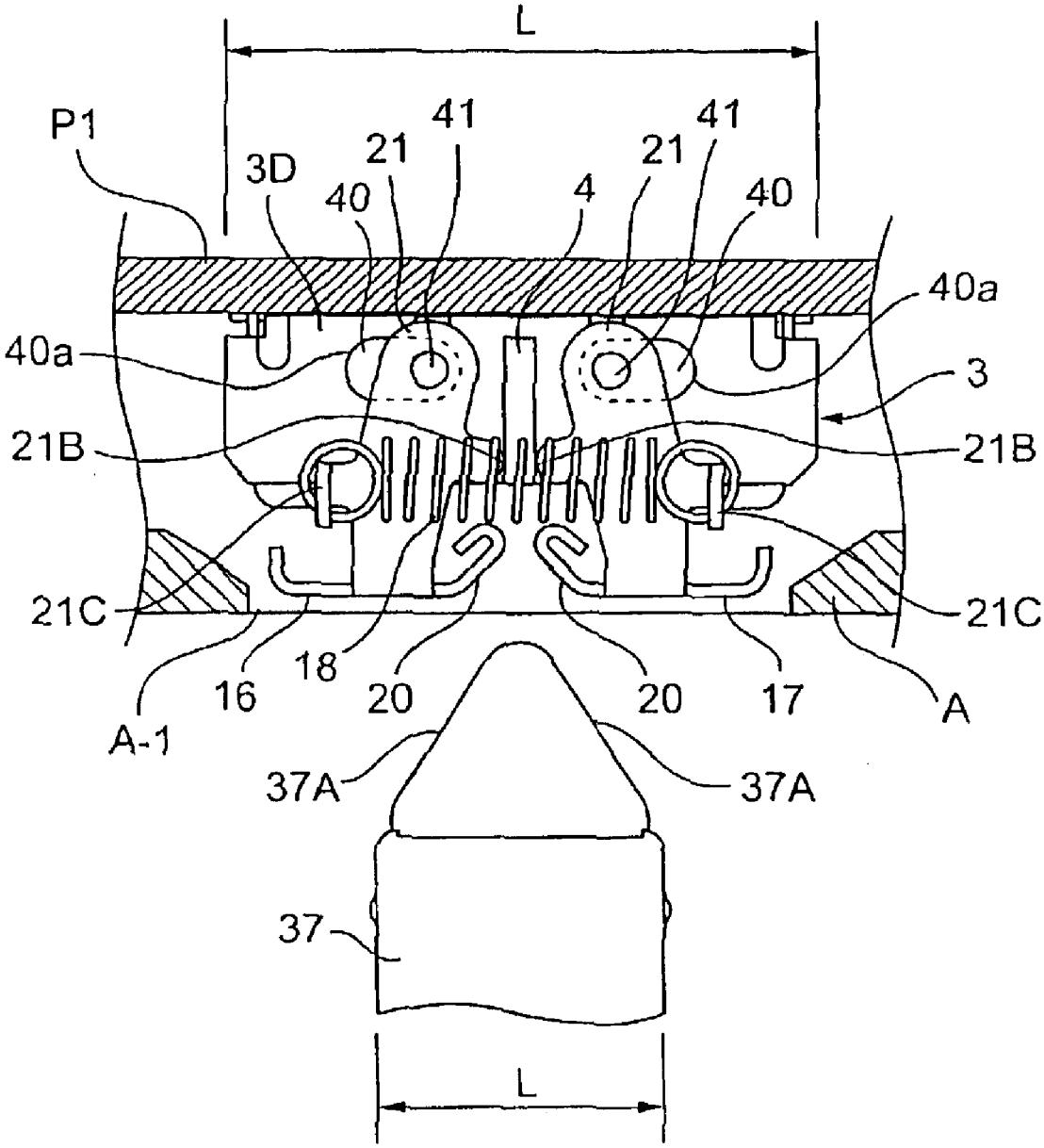
FIG. 9 is a sectional view of an electrical connector according to the second embodiment of the invention, showing the shutter mechanism.
Figure 10:
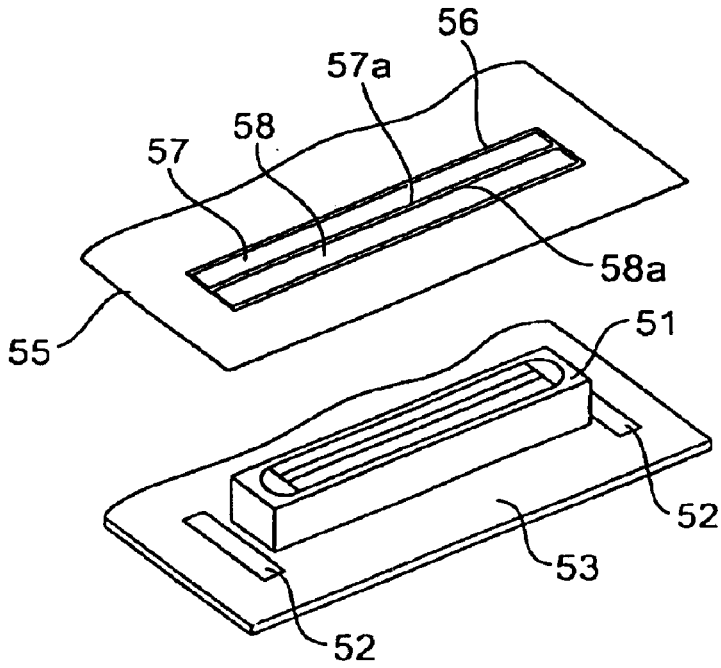
FIG. 10 PRIOR ART
FIG. 10 is a perspective view of an electrical connector receptacle according to the prior art.
Figure 11:
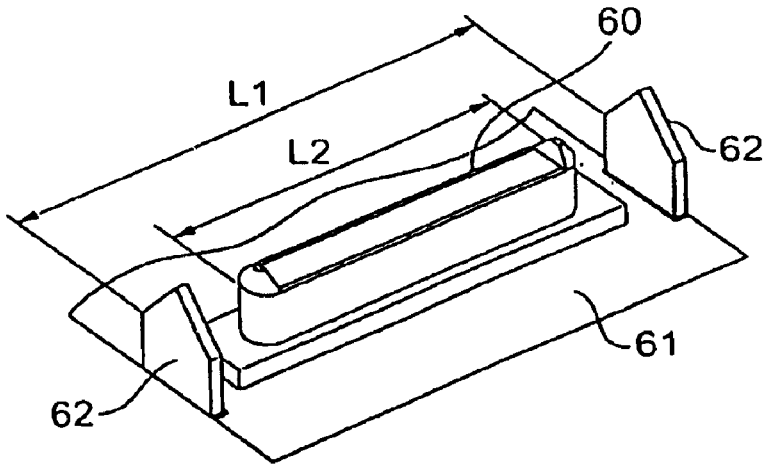
FIG. 11 PRIOR ART
FIG. 11 is a perspective view of an electrical connector plug according to the prior art.

In FIG. 9, the second embodiment is different from the first embodiment in the attaching mechanism of the shutter members 16 and 17 to the end walls 3D and 3E of the insulating case 3. A stopper 4 is provided between the end walls 3D and 3E of the insulating case 3, and a pair of bearing holes 40 are provided on opposite sides of the stopper 4. The bearing holes 40 are elongated in the widthwise direction of the insulating case 3. A shaft 41 is provided on each arm 21 of the shutter members 16 and 17. The shaft 41 of the shutter 16 is supported in the bearing holes 40 for rotation by the end walls 3D and 3E of the insulating case 3. A spring member 18 is put between the spring engaging sections 21C of the shutter members 16 and 17 to pull inwardly the shutter members 16 and 17 so that the stopper sections 21B abut against the stopper 4 to bring the sliding sections 20 to a close position. Under this closed condition, the shutter members 16 and 17 cover the plug fitting section 39. Consequently, when the portable information processor is brought to a position close to the CD-ROM, the guide pins 37 of the plug 2 enter between the sliding sections 20 of the shutter members 16 and 17. Then, the guide faces 37A of the guide pins 37 slide on the sliding faces 20 of the shutter members 16 and 17 so that the shafts 41 of the arm sections 21 are moved rearwardly against the spring members 18 and abut against the outer ends 40A and the shutter members 16 and 17 rotate about the shafts 41 to open the plug fitting section 39 of the receptacle 1.

Then, the guide pins 37 enter the pin apertures 6 of the receptacle 1 while the fitting projection 31 of the plug 2 enters the plug fitting section 39 of the receptacle 1, bringing the signal terminals 13 of the receptacle 1 into the mating terminal insertion recess 32. Consequently, the contact sections 13A of the signal terminals 13 and the contact section 14A of the shield member 14 are brought into contact with the contact sections 36A of the signal terminals 36 and the contact section 38A of the shield member 38, respectively, thus connecting the receptacle 1 and the plug 2.

When the portable information processor is lifted from the CD-ROM, the guide pins 37 come out of the pin apertures 6 of the receptacle 1, and the fitting projection 31 of the plug 2 comes out of the plug fitting section 39 of the receptacle 1 while the signal terminals of the receptacle 1 come out of the mating terminal insertion recess 32. Consequently, not only the contact between both the signal terminals 13 and 36 is released but also the contact between both the shield members 14 and 38 is released to disconnect the receptacle 1 and the plug 2. Then, the guide faces 37A of the guide pins 37 slide on the sliding sections 20 of the shutter members 16 and 17 for separation so that the spring member 18 pulls the shutter members 16 and 17 inwardly about the shaft 41 to cover the plug fitting section 39 of the receptacle 1, moving the shaft 41 inwardly in the bearing holes 40.

According to the second embodiment, when the guide pins 37 open the shutter members 16 and 17, the shaft 40 is moved in the bearing holes 40 to the ends 40*a*, where the shutter members 16 and 17 are opened. Consequently, the shutter members 16 and 17 are opened widely in the widthwise direction of the receptacle 1, making it possible that the receptacle 1 or plug 2 has a large width L. The shaft 41 is attached to the arms 21 of the shutter members 16 and 17, and the bearing holes 40 are provided in the end walls 3D and 3E of the insulating case 3, but the shaft 41 and the bearing holes 40 may be provided on the end walls 3D and 3E, and the arms 21, respectively. The spring member 18 is provided on one of the shutter members 16 and 17, but a couple of spring members may be provided on both of the arms 21. The spring member 18 may be a leaf spring as well as a coil spring.

As has been described above, according to the invention, the shutter is provided one of the connectors so that the positioning of the shutter with respect to the connector is accurate without little displacement, thus minimizing the shutter malfunction due to the displacement and facilitating the connection between the connectors. In addition, the shutter opening mechanism is provided on the other connector, the shutter mechanism including the shutter opening device not only occupies a small space but also minimizes the number of components.

In addition, the shafts of the shutter members move in the bearing holes to the ends to open the shutter members widely in the widthwise direction of the connector, making it possible that the connector has a large width. The connector is a low-profile connector that has a terminal receiving channel forming section that extends toward the mating connector fitting section so that the shutter is provided on the low-profile connector. The shutter members are made from a metal or heat-resistance plastic so that it is possible to solder the connector with them to a PCB, thus minimizing the number of manufacturing steps.

What is claimed is:

1. An electrical connector system, comprising:

a first connector including an insulating case with a mating connector fitting section provided therein and a shutter made by a pair of shutter members provided outside said insulating case and closing said mating connector fitting section, said respective shutter members including a pair of arms provided at opposite ends in a lengthwise direction thereof and rotatably supported on opposite side walls of said first connector for attaching said pair of shutter members to said first connector;

a second connector having a fitting projection made of an insulating material; and means for moving said shutter members to open said mating connector fitting section for receiving said fitting projection of said second connector, thereby connecting said first and second connectors, for moving the shutter members to open the mating connector fitting section said moving means including at least one guide pin provided on said fitting projection of said second connector, said shutter comprising a pair of sliding sections provided at edges thereof for sliding said guide pin, and wherein said first connector comprising a spring member for pushing said pair of shutter members toward each other to keep said sliding sections close to each other, thereby covering said mating connector fitting section.

2. The electrical connector system according to claim 1, wherein said first connector comprises one of a shaft and a bearing hole, and said arm comprises the other of said shaft and bearing hole so that said pair of shutter members is rotatably attached to said first connector by engagement between said shaft and said bearing hole.

3. The electrical connector system according to claim 1, wherein said first connector comprises one of a shaft and an elongated bearing hole, and said arm comprises the other of said shaft and elongated bearing hole so that said pair of shutter members is rotatably attached to said first connector by engagement between said shaft and said elongated bearing hole.

4. The electrical connector according to claim 1, wherein said first connector is a low-profile connector having a terminal channel forming section provided in said insulating case and extending toward said mating connector fitting section.

5. The electrical connector according to claim 1, wherein said pair of shutter members are made from either metal or heat-resistant plastic.

6. An electrical connector system, comprising:

a first connector including an insulating case with a mating connector fitting section provided therein and a shutter made by a pair of shutter members provided outside said insulating case and closing said mating connector fitting section, said respective shutter members including a pair of arms provided at opposite ends in a lengthwise direction thereof and rotatatly supported on opposite side walls of said first connector for attaching said pair of shutter members to said first connector;

a second connector having a fitting projection made of an insulating material; and means for moving said shutter members to open said mating connector fitting section for receiving said fitting projection of said second connector, thereby connecting said first and second connectors, said first connector comprising a stopper, each of said arms comprising a stopper section so that said stopper sections abut against said stopper section only when said pair of shutter members are pushed toward each other and closed by a spring member provided in said first connector.

7. The electrical connector system according to claim 6, wherein said moving means includes at least one guide pin provided on said fitting projection of said second connector.

8. The electrical connector system according to claim 6, wherein said first connector comprises one of a shaft and a bearing hole, and said arm comprises the other of said shaft and bearing hole so that said pair of shutter members is rotatably attached to said first connector by engagement between said shaft and said bearing hole.

9. The electrical connector system according to claim 6, wherein said first connector comprises one of a shaft and an elongated bearing hole, and said arm comprises the other of said shaft and elongated bearing hole so that said pair of shutter members is rotatably attached to said first connector by engagement between said shaft and said elongated bearing hole.

10. The electrical connector according to claim 6, wherein said first connector is a low-profile connector having a terminal channel forming section provided in said insulating case and extending toward said mating connector fitting section.

11. The electrical connector according to claim 6, wherein said pair of shutter member are made from either metal or heat-resistant plastic.

* * * * *